US011499438B2

(12) United States Patent
Joo

(10) Patent No.: US 11,499,438 B2
(45) Date of Patent: Nov. 15, 2022

(54) TURBINE VANE, AND TURBINE AND GAS TURBINE INCLUDING THE SAME

(71) Applicant: DOOSAN ENERBILITY CO., LTD., Changwon-si (KR)

(72) Inventor: Hyun Woo Joo, Changwon (KR)

( * ) Notice: Subject to any disclaimer, the term of this patent is extended or adjusted under 35 U.S.C. 154(b) by 0 days.

(21) Appl. No.: 17/684,733

(22) Filed: Mar. 2, 2022

(65) Prior Publication Data

US 2022/0186626 A1 Jun. 16, 2022

Related U.S. Application Data

(62) Division of application No. 16/889,368, filed on Jun. 1, 2020, now Pat. No. 11,299,996.

(30) Foreign Application Priority Data

Jun. 21, 2019 (KR) ..... 10-2019-0075793

(51) Int. Cl.
*F01D 9/06* (2006.01)
*F01D 9/04* (2006.01)
(Continued)

(52) U.S. Cl.
CPC ..... *F01D 9/06* (2013.01); *F01D 5/187* (2013.01); *F01D 9/02* (2013.01); *F01D 9/042* (2013.01); *F01D 9/065* (2013.01); *F01D 25/12* (2013.01); *F05D 2240/12* (2013.01); *F05D 2250/185* (2013.01); *F05D 2260/2214* (2013.01)

(58) Field of Classification Search
CPC . F01D 5/186; F01D 5/187; F01D 9/02; F01D 9/041; F01D 9/042; F01D 9/06; F01D 9/065; F01D 25/12; F05D 2240/12; F05D 2250/185; F05D 2260/202; F05D 2260/2214
See application file for complete search history.

(56) References Cited

U.S. PATENT DOCUMENTS 8,221,055 B1 7/2012 Liang
8,628,294 B1 1/2014 Liang
(Continued)

FOREIGN PATENT DOCUMENTS

DE 102015203175 A1 8/2016
JP 2013083270 A 5/2013

OTHER PUBLICATIONS

DE OA dated May 5, 2022.
CN OA dated May 25, 2022.

*Primary Examiner* — Courtney D Heinle
*Assistant Examiner* — Danielle M. Christensen
(74) *Attorney, Agent, or Firm* — Harvest IP Law, LLP

(57) ABSTRACT

A turbine vane, a turbine, and a gas turbine capable of reducing thermal stress are provided. The turbine vane may include an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, and a first passage bending part configured to connect the first cooling passage and the second cooling passage, and the first passage bending part is positioned inside the inner shroud or the outer shroud.

20 Claims, 9 Drawing Sheets

(51) Int. Cl.

| | |
|---|---|
| ***F01D 9/02*** | (2006.01) |
| ***F01D 5/18*** | (2006.01) |
| ***F01D 25/12*** | (2006.01) |

(56) References Cited

U.S. PATENT DOCUMENTS

| | | | | |
|---|---|---|---|---|
| 8,864,467 | B1 * | 10/2014 | Liang | F01D 5/187 416/97 R |
| 2009/0081029 | A1 | 3/2009 | Dalton | |
| 2017/0130598 | A1 | 5/2017 | Liang | |

* cited by examiner

TURBINE VANE, AND TURBINE AND GAS TURBINE INCLUDING THE SAME

CROSS-REFERENCE TO RELATED APPLICATION

This is a divisional application of U.S. application Ser. No. 16/889,368 filed on Jun. 1, 2020 which claims priority to Korean Patent Application No. 10-2019-0074349, filed on Jun. 21, 2019, the disclosure of which is incorporated by reference herein in its entirety.

BACKGROUND

Field

Apparatuses and methods consistent with exemplary embodiments relate to a turbine vane, and a turbine and a gas turbine including the same.

Description of the Related Art

A gas turbine is a power engine which mixes fuel with air compressed in a compressor, combusts the mixture of the fuel and the compressed air, and rotates a turbine with high-temperature gas generated by the combustion. The gas turbine is used to drive a generator, an aircraft, a ship, a train, or the like.

The gas turbine includes a compressor, a combustor, and a turbine. The compressor draws and compresses outside air and transmits the compressed air to the combustor. The combustor mixes fuel with the compressed air supplied from the compressor, and combusts the mixture of the fuel and the compressed air to generate high-pressure and a high-temperature combustion gas. The combustion gas generated by the combustion is discharged to the turbine. A turbine blade provided in the turbine is rotated by the combustion gas, and a power is generated. The generated power may be used in various fields such as power generation and driving of a mechanical device.

Recently, in order to increase turbine efficiency, the temperature of the gas flowing into the turbine (i.e., Turbine Inlet Temperature (TIT)) is in a trend of continuously increasing, and thus, the importance of heat resistance treatment and cooling of the turbine blade has been emphasized.

In particular, among the internal passages of the vanes, the structural life of the passage bending part in which a direction of the passage is changed is evaluated to be low because the thermal stress is concentrated. If the structural life of the passage bending part is evaluated to be low, the overall life of the turbine vane is lowered, which increases the maintenance cost.

SUMMARY

Aspects of one or more exemplary embodiments provide a turbine vane, a turbine, and a gas turbine capable of reducing thermal stress.

Additional aspects will be set forth in part in the description which follows and, in part, will become apparent from the description, or may be learned by practice of the exemplary embodiments.

According to an aspect of an exemplary embodiment, there is provided a turbine vane including: an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, and a first passage bending part configured to connect the first cooling passage and the second cooling passage, wherein the first passage bending part is positioned inside the inner shroud or the outer shroud.

The first passage bending part may include a first curved surface which is curved in an arc shape around a first point which is positioned inside the inner shroud or the outer shroud.

The turbine vane may further include a first partition wall configured to split the first cooling passage and the second cooling passage, and extend in a height direction of the airfoil, and a longitudinal end of the first partition wall may be positioned further outward than an end of the airfoil.

The inner shroud may include an inner platform connected to an inner end of the airfoil and an inner hook protruding from the inner platform, and the inner platform may include an inner protrusion which protrudes to form a space therein, and the first passage bending part may be positioned inside the inner protrusion.

The first partition wall may include a plurality of inducing holes which penetrate the first partition wall in a thickness direction thereof, and some inducing holes may be disposed further outward than the end of the airfoil with respect to a center of the turbine vane.

Some inducing holes may be positioned on a boundary surface in which the airfoil and the inner platform are connected.

The first partition wall may include a first passage extending in a thickness direction of the first partition wall and a second passage which is connected to the first passage and extends to an end of the first partition wall, and the first passage may be positioned inside the airfoil, and the second passage may extend from an interior of the airfoil to an interior of the inner shroud.

A plurality of porous plates may be formed to protrude from the first partition wall, the porous plates being positioned on the first passage bending part.

The turbine vane may further include a third cooling passage configured to extend in a height direction thereof and a second passage bending part configured to connect the second cooling passage and the third cooling passage, and the second passage bending part may include a second curved surface which is curved in an arc shape around a second point which is positioned inside the outer shroud.

The outer shroud may include an outer platform connected to an outer end of the airfoil and an outer hook protruding from the outer platform, and the outer platform may include an outer protrusion which protrudes outward and forms a space therein and the second passage bending part may be positioned inside the outer protrusion.

The outer protrusion may include a transverse cross section shaped like the airfoil.

The turbine vane may further include a third cooling passage configured to extend in a height direction thereof and a second partition wall configured to split the second cooling passage and the third cooling passage, and extend in a height direction of the airfoil, and a longitudinal end of the second partition wall may be positioned inside the outer shroud.

According to an aspect of another exemplary embodiment, there is provided a turbine including: a rotor disk configured to be rotatable, and a plurality of turbine blades and turbine vanes which are installed on the rotor disk. The turbine vane may include an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, and a first passage bending part configured to connect the first cooling passage and the second cooling passage, and to include a first curved surface curved in an arc shape around a first point, and the first point is positioned inside the inner shroud or the outer shroud.

The turbine may further include a first partition wall configured to split the first cooling passage and the second cooling passage, and extend in a height direction of the airfoil, and a longitudinal end of the first partition wall may be positioned further outward than an end of the airfoil.

The inner shroud may include an inner platform connected to an inner end of the airfoil and an inner hook protruding from the inner platform, and the inner platform may include an inner protrusion which protrudes to form a space therein, and the first passage bending part may be positioned inside the inner protrusion.

The first partition wall may include a plurality of inducing holes which penetrate the first partition wall in a thickness direction thereof, and some inducing holes may be formed outside the airfoil.

Some inducing holes may be positioned on a boundary surface in which the airfoil and the inner platform are connected.

The first partition wall may include a first passage extending in a thickness direction of the first partition wall and a second passage which is connected to the first passage and extends to an end of the first partition wall, and the first passage may be positioned inside the airfoil, and the second passage may extend from an interior of the airfoil to an interior of the inner shroud.

A plurality of porous plates may be formed to protrude from the first partition wall, the porous plates being positioned on the first passage bending part.

According an aspect of another exemplary embodiment, there is provided a gas turbine including: a compressor configured to compress air drawn thereinto from an outside, a combustor configured to mix fuel with air compressed by the compressor and combust a mixture of the fuel and the compressed air, and a turbine including a plurality of turbine blades configured to be rotated by combustion gas discharged from the combustor. The turbine may include a rotor disk configured to be rotatable, and a plurality of turbine blades and turbine vanes which are installed on the rotor disk. The turbine vane may include an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, and a first passage bending part configured to connect the first cooling passage and the second cooling passage, and the first point is positioned inside the inner shroud or the outer shroud.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
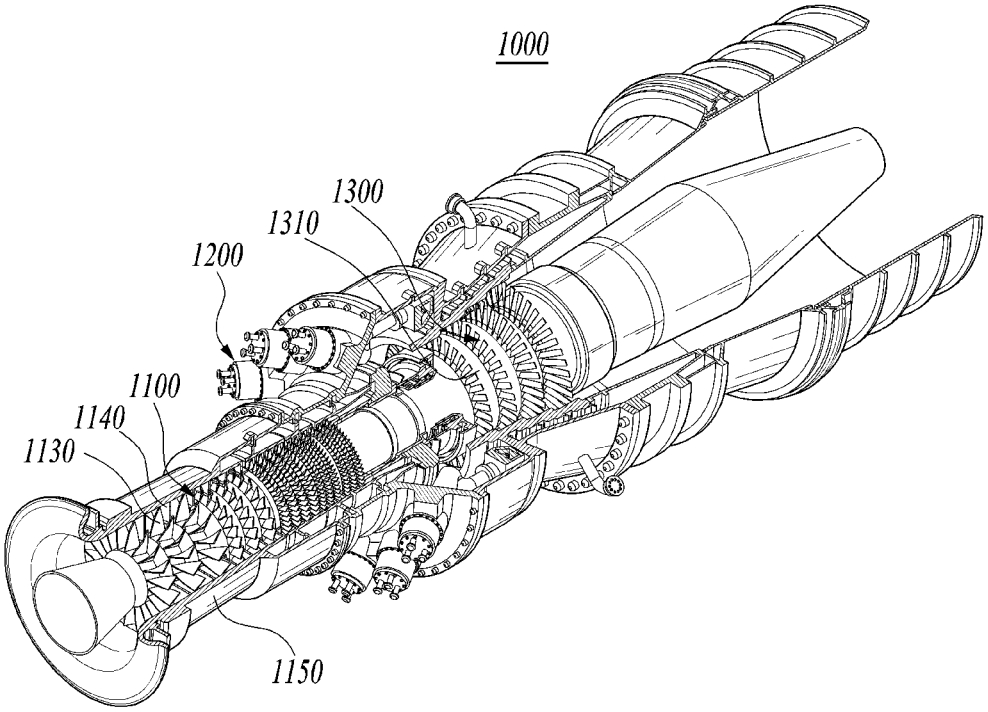
FIG. 1 is a diagram illustrating an internal structure of a gas turbine according to an exemplary embodiment.

Various changes and various embodiments will be described in detail with reference to the drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and technical scope disclosed herein.

The terminology used herein is for the purpose of describing specific embodiments only, and is not intended to limit the scope of the disclosure. The singular expressions "a", "an", and "the" may include the plural expressions as well, unless the context clearly indicates otherwise. In the disclosure, the terms such as "comprise", "include", "have/has" should be construed as designating that there are such features, integers, steps, operations, components, parts, and/or combinations thereof, not to exclude the presence or possibility of adding one or more other features, integers, steps, operations, components, parts and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, exemplary embodiments will be described in detail with reference to the accompanying drawings. Reference now should be made to the drawings, in which the same reference numerals are used throughout the different drawings to designate the same or similar components. Details of well-known configurations and functions may be omitted to avoid unnecessarily obscuring the gist of the present disclosure. For the same reason, some components in the accompanying drawings are exaggerated, omitted, or schematically illustrated.

Figure 2:
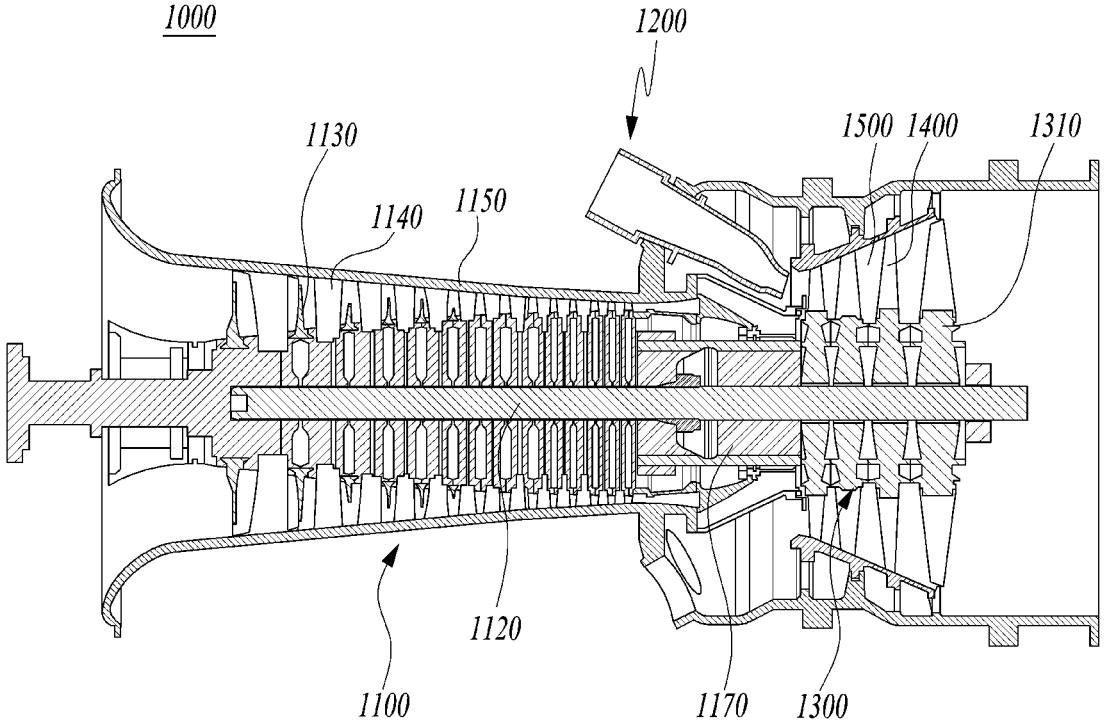
FIG. 2 is a longitudinal cross-sectional diagram illustrating a part of the gas turbine of FIG. 1.

FIG. 1 is a diagram illustrating an internal structure of a gas turbine according to an exemplary embodiment, and FIG. 2 is a longitudinal cross-sectional diagram illustrating a part of the gas turbine of FIG. 1.

For example, a thermodynamic cycle of a gas turbine 1000 according to the exemplary embodiment may ideally comply with a Brayton cycle. The Brighton cycle may be composed of four processes which include an isentropic compression (i.e., adiabatic compression), a constant-pressure rapid heating, an isentropic expansion (i.e., adiabatic expansion), and a constant-pressure heat dissipation. In other words, the gas turbine may draw the atmospheric air, compress the air to a high pressure, combust fuel in a constant-pressure environment to emit thermal energy, expand the high-temperature combustion gas to convert the thermal energy of the combustion gas into kinetic energy, and discharge exhaust gas containing residual energy to the atmosphere. That is, the Brayton cycle may be performed in four processes including compression, heating, expansion, and heat dissipation.

Referring to FIGS. 1 and 2, the gas turbine 1000 embodying the Brayton cycle may include a compressor 1100, a combustor 1200, and a turbine 1300.

The compressor 1100 may draw air from the outside and compress the air. The compressor 1100 may supply the compressed air compressed by a compressor blade 1130 to the combustor 1200, and also supply the compressed air for cooling to a high-temperature region needed to be cooled in the gas turbine 1000. Here, because the drawn air is subjected to an adiabatic compression process in the compressor 1100, the pressure and temperature of the air passing through the compressor 1100 are increased.

The compressor 1100 is designed in the form of a centrifugal compressor or an axial compressor. The centrifugal compressor is used in a small gas turbine, whereas a multi-stage axial compressor 1100 is used in a large gas turbine such as the gas turbine 1000 illustrated in FIG. 1 to compress a large amount of air. In the multi-stage axial compressor 1100, a compressor blade 1130 moves the compressed air to a compressor vane 1140 disposed at a following stage while compressing the introduced air by rotating along with rotation of a center tie rod 1120 and a rotor disk. The air is compressed gradually to a high pressure while passing through the compressor blade 1130 formed in a multi-stage structure.

The compressor vane 1140 is mounted inside a housing 1150in such a way that a plurality of compressor vanes 1140 form each stage. The compressor vane 1140 guides the compressed air moved from the compressor blade 1130 disposed at a preceding stage toward the compressor blade 1130 disposed at the following stage. In an exemplary embodiment, at least some of the plurality of compressor vanes 1140 may be mounted to be rotatable within a predetermined range for adjusting the amount of introduced air.

The compressor 1100 may be driven by using some of the power output from the turbine 1300. To this end, a rotary shaft of the compressor 1100 and a rotary shaft of the turbine 1300 may be directly connected by a torque tube 1170. In the case of the large gas turbine 1000, almost half of the output produced by the turbine 1300 may be consumed to drive the compressor 1100.

The combustor 1200 may produce high-energy combustion gas by mixing and combusting, at constant pressure, the compressed air supplied from the compressor 1100 with the fuel. The combustor 1200 produces high-temperature and high-pressure combustion gas having high energy by mixing and combusting the introduced compressed air with the fuel, and increases the temperature of the combustion gas to a heat-resistant limit temperature at which the combustor and the turbine may withstand through the constant pressure combustion process.

A plurality of combustors constituting the combustor 1200 may be arranged within the housing in a form of a cell. Each of the combustors includes a burner which includes a fuel injection nozzle, a combustor liner which forms a combustion chamber, and a transition piece which becomes a connection part between the combustor and the turbine.

The high-temperature and high-pressure combustion gas ejected from the combustor 1200 is supplied to the turbine 1300. The supplied high-temperature and high-pressure combustion gas expands and applies impingement or reaction force to a turbine blade 1400 of the turbine 1300 to generate rotation torque. A portion of the rotation torque is delivered to the compressor 1100 through the torque tube 1170, and the remaining portion which is the excessive torque is used to drive a generator or the like.

The turbine 1300 includes a rotor disk 1310 and a plurality of turbine blades 1400 and turbine vanes 1500 which are radially disposed on the rotor disk 1310.

The rotor disk 1310 has a substantially disk shape, and a plurality of grooves are formed in an outer circumferential portion thereof. The groove is formed to have a curved surface, and the turbine blade 1400 and the turbine vane 1500 are inserted into the groove. The turbine blade 1400 may be coupled to the rotor disk 1310 in a dovetail manner. The turbine vane 1500 fixed to the housing is provided between the turbine blades 1400 to guide a flow direction of the combustion gas passing through the turbine blade 1400.

Figure 3:
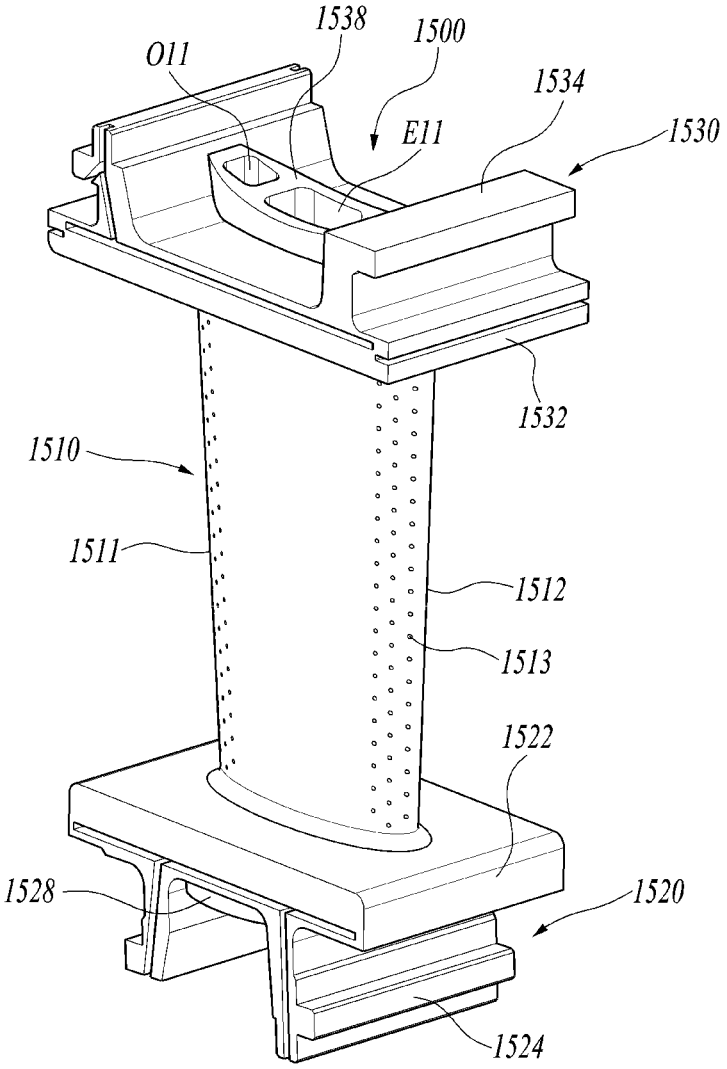
FIG. 3 is a perspective diagram illustrating a turbine vane according to an exemplary embodiment.
Figure 4:
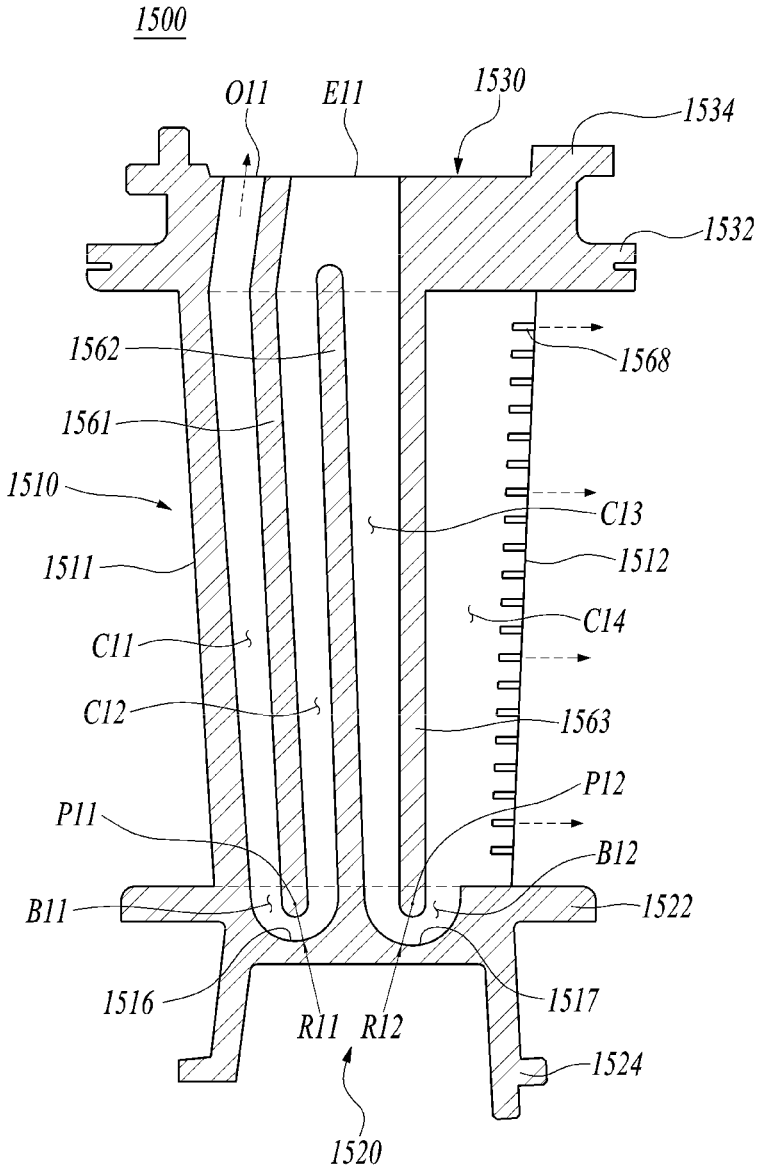
FIG. 4 is a longitudinal cross-sectional diagram illustrating the turbine vane according to an exemplary embodiment.
Figure 5:
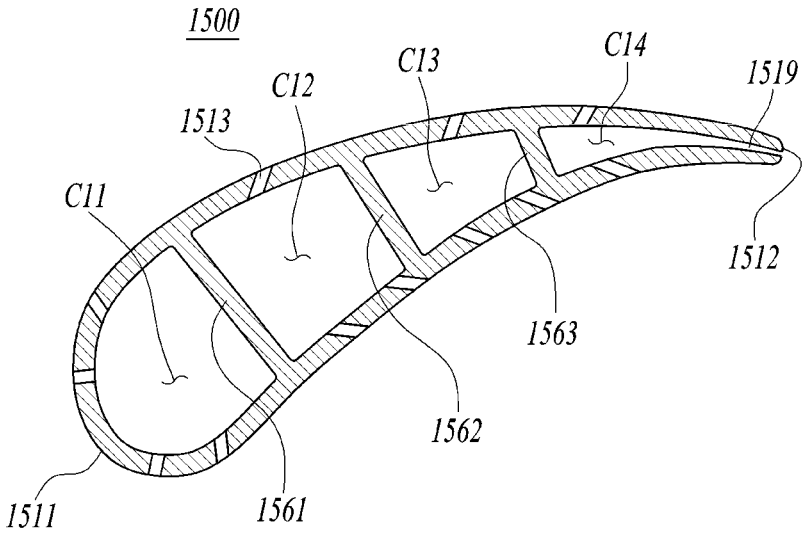
FIG. 5 is a transverse cross-sectional diagram illustrating the turbine vane according to an exemplary embodiment.

FIG. 3 is a perspective diagram illustrating a turbine blade according to an exemplary embodiment, FIG. 4 is a longitudinal cross-sectional diagram illustrating the turbine blade according to the exemplary embodiment, and FIG. 5 is a transverse cross-sectional diagram illustrating a vane according to the exemplary embodiment.

Referring to FIGS. 3 to 5, the turbine vane 1500 includes an inner shroud 1520, an outer shroud 1530, and an airfoil 1510 which is positioned between the inner shroud 1520 and the outer shroud 1530.

The airfoil 1510 may be a curved plate having a wing shape, and have an optimized airfoil according to the specification of the gas turbine 1000. The airfoil 1510 may include a leading edge 1511 disposed at an upstream side and a trailing edge 1512 disposed at a downstream side with respect to a flow direction of the combustion gas.

A front surface of the airfoil 1510 onto which the combustion gas is introduced is formed with a suction surface protruding outward to have an outward-convex curved surface, and a rear surface of the airfoil 1510 is formed with a pressure surface having a curved surface concavely recessed toward the suction surface. A pressure difference between the suction surface and the pressure surface of the airfoil 1510 occurs to rotate the turbine 1300.

A plurality of cooling holes 1513 are formed in a surface of the airfoil 1510. The cooling holes 1513 communicate with a cooling passage formed inside the airfoil 1510 to supply the cooling air to the surface of the airfoil 1510.

The inner shroud 1520 is coupled to the rotor disk 1310 and is disposed at an inner end of the airfoil 1510 to support the airfoil 1510. The inner shroud 1520 includes an inner platform 1522 coupled to the interior of the airfoil 1510 and an inner hook 1524 which protrudes downward from the inner platform 1522 and is coupled to the rotor disk 1310.

The inner platform 1522 is formed in a substantially rectangular plate shape and is formed with an inner protrusion 1528 which protrudes to form a space therein. The inner protrusion 1528 protrudes inward, which is a direction toward the rotor disk 1310, and has a transverse cross section shaped like the airfoil. That is, the transverse cross section of the inner protrusion 1528 includes a convex surface and a concave surface, and is formed so that a gap between the convex surface and the concave surface reduces toward the side end thereof.

The outer shroud 1530 is coupled to a vane carrier (not illustrated) installed outside in a radial direction thereof and is disposed at an outer end of the airfoil 1510 to support the airfoil 1510. The outer shroud 1530 includes an outer platform 1532 coupled to the outer end of the airfoil 1510 and an outer hook 1534 which protrudes upward from the outer platform 1532 and is coupled to the vane carrier.

The outer platform 1532 is formed in a substantially rectangular plate shape and the outer platform 1532 is formed with an outer protrusion 1538 which protrudes to form a space therein. The outer protrusion 1538 protrudes outward, and has the transverse cross section shaped like the airfoil. That is, the transverse cross section of the outer protrusion 1538 includes a convex surface and a concave surface, and is formed so that an interval between the convex surface and the concave surface reduces toward the side end thereof. The outer protrusion 1538 may be formed with an inlet (E11) through which the cooling medium is introduced and an outlet (O11) through which the cooling medium is discharged. For example, the cooling medium may include the air compressed by the compressor. It is understood that the cooling medium is not limited thereto.

A first cooling passage (C11), a second cooling passage (C12), a third cooling passage (C13), a fourth cooling passage (C14), a first passage bending part (B11), a second passage bending part (B12), a first partition wall 1561, a second partition wall 1562, and a third partition wall 1563 are formed inside the turbine vane 1500. The turbine vane 1500 may be formed by casting.

The first cooling passage (C11) is connected to the outlet (O11), and is formed to extend from the outer shroud 1530 to the interior of the inner shroud 1520 through the airfoil 1510. The first cooling passage (C11) is formed by the first partition wall 1561 and the leading edge 1511, and is formed to penetrate the outer protrusion 1538, the outer platform 1532, and the airfoil 1510 in a height direction thereof.

The second cooling passage (C12) is connected to the inlet (E11), and is formed to extend from the outer shroud 1530 to the interior of the inner shroud 1520 through the airfoil 1510. The second cooling passage (C12) is formed by the first partition wall 1561 and the second partition wall 1562. The air introduced through the second cooling passage (C12) may be supplied to the first cooling passage (C11).

The first partition wall 1561 is positioned between the first cooling passage (C11) and the second cooling passage (C12), and splits the first cooling passage (C11) and the second cooling passage (C12). The longitudinal outer end of the first partition wall 1561 is fixed to the outer shroud 1530, and the longitudinal inner end of the first partition wall 1561 is positioned to be spaced apart from the end of the airfoil 1510. That is, the first partition wall 1561 is formed to penetrate the airfoil 1510 and extend to the interior of the inner shroud 1520.

The first cooling passage (C11) and the second cooling passage (C12) are connected by the first passage bending part (B11) which is spaced apart from the end of the airfoil 1510 and positioned inside the inner shroud 1520. For example, the first passage bending part (B11) may be positioned within the inner protrusion 1528. In addition, the first passage bending part (B11) has a first curved surface 1516 which is curved in an arc shape and has an arc-shaped cross section having a first radius (R11) around a first point (P11). Here, the first point (P11) is spaced apart from the end of the airfoil 1510 and positioned inside the inner shroud 1520. That is, the first point (P11) may also be positioned within the first partition wall 1561. Accordingly, the first partition wall 1561 may serve as a heat-dissipation plate which discharges heat.

Although the turbine vane 1500 is entirely cooled by the cooling passage, it is confirmed that thermal stress is concentrated in the first passage bending part (B11) which is a portion in which the cooling passage is switched, thereby reducing the life of the structure.

The hot gas passes through only a portion in which the airfoil 1510 is formed, and the inner shroud 1520 and the outer shroud 1530 are fitted into other members, thereby not contacting the hot gas. Accordingly, if the first passage bending part (B11) is positioned inside the inner shroud 1520, thermal stress applied to the first passage bending part (B11) may be minimized.

In addition, the thermal stress becomes the maximum at the center point of the curved surface which is curved in the first passage bending part (B11), such that if the first point (P11) is positioned inside the inner shroud 1520, the life of the structure may be significantly improved. Even if a part of the first passage bending part (B11) is positioned within the inner shroud 1520, the degree of reduction in the thermal stress appears to be insignificant if the first point (P11) is positioned within the airfoil 1510.

It is understood that although the first passage bending part (B11) is exemplarily formed inside, it is not limited thereto. For example, if the first passage bending part is formed outside, the first passage bending part and the first point may also be positioned inside the outer shroud.

In the related art structure, it has been impossible to form the passage bending part inside the inner shroud because the inner platform is thin. However, if the inner protrusion 1528 is formed, the first passage bending part (B11) may be positioned inside the inner protrusion 1528, thereby minimizing the thermal stress and improving the life of the structure.

The third cooling passage (C13) disposed adjacent to the second cooling passage (C12) is formed to extend from the outer shroud 1530 to the interior of the inner shroud 1520 through the airfoil 1510. The third cooling passage (C13) is formed by the second partition wall 1562 and the third partition wall 1563, and is formed to penetrate the outer protrusion 1538, the outer platform 1532, and the airfoil 1510 in a height direction thereof.

The third cooling passage (C13) is connected to the inlet (E11), and the air introduced through the inlet (E11) moves by being split into the second cooling passage (C12) and the third cooling passage (C13), respectively. The air moving through the third cooling passage (C13) may be supplied to the fourth cooling passage (C14).

The second partition wall 1562 is positioned between the second cooling passage (C12) and the third cooling passage (C13), and splits the second cooling passage (C12) and the third cooling passage (C13). The longitudinal inner end of the second partition wall 1562 is fixed to the inner shroud 1520, and the longitudinal outer end thereof is positioned more outward than the end of the airfoil 1510. That is, the second partition wall 1562 penetrates the airfoil 1510 and extends to the interior of the outer shroud 1530 but is spaced apart from the inlet (E11). Accordingly, it is possible to prevent the thermal stress from being concentrated at the end of the second partition wall 1562.

The fourth cooling passage (C14) disposed between the third cooling passage (C13) and the trailing edge 1512 is formed to extend to the airfoil 1510 and the interior of the inner shroud 1520. The fourth cooling passage (C14) is formed by the third partition wall 1563 and the trailing edge 1512. The fourth cooling passage (C14) receives air from the third cooling passage (C13) and the air introduced into the fourth cooling passage (C14) is discharged through the trailing edge 1512. A rear end cooling slot 1519 is formed on the trailing edge 1512, a split protrusion 1568 is formed on the rear end cooling slot 1519, and the air cools the trailing edge 1512 while being discharged through the rear end cooling slot 1519.

The third partition wall 1563 is positioned between the third cooling passage (C13) and the fourth cooling passage (C14), and splits the third cooling passage (C13) and the fourth cooling passage (C14). The longitudinal outer end of the third partition wall 1563 is fixed to the outer shroud 1530, and the longitudinal inner end of the third partition wall 1563 is spaced apart from the end of the airfoil 1510 and positioned further outward than the center of the turbine vane 1500. That is, the third partition wall 1563 is formed to penetrate the airfoil 1510 and extend to the interior of the inner shroud 1520.

The third cooling passage (C13) and the fourth cooling passage (C14) are connected by the second passage bending part (B12) which is spaced apart from the end of the airfoil 1510 and positioned inside the inner shroud 1520. For example, the second passage bending part (B12) may be positioned within the inner platform 1522 and the inner protrusion 1528. In addition, the second passage bending part (B12) has a second curved surface 1517 which is curved in an arc shape and has an arc-shaped cross section having a second radius (R12) around a second point (P12). Here, the second point (P12) is spaced apart from the end of the airfoil 1510 and positioned inside the inner shroud 1520. Accordingly, thermal stress generated in the second passage bending part (B12) may be minimized and the life of the structure in the second passage bending part (B12) may be improved.

Figure 6:
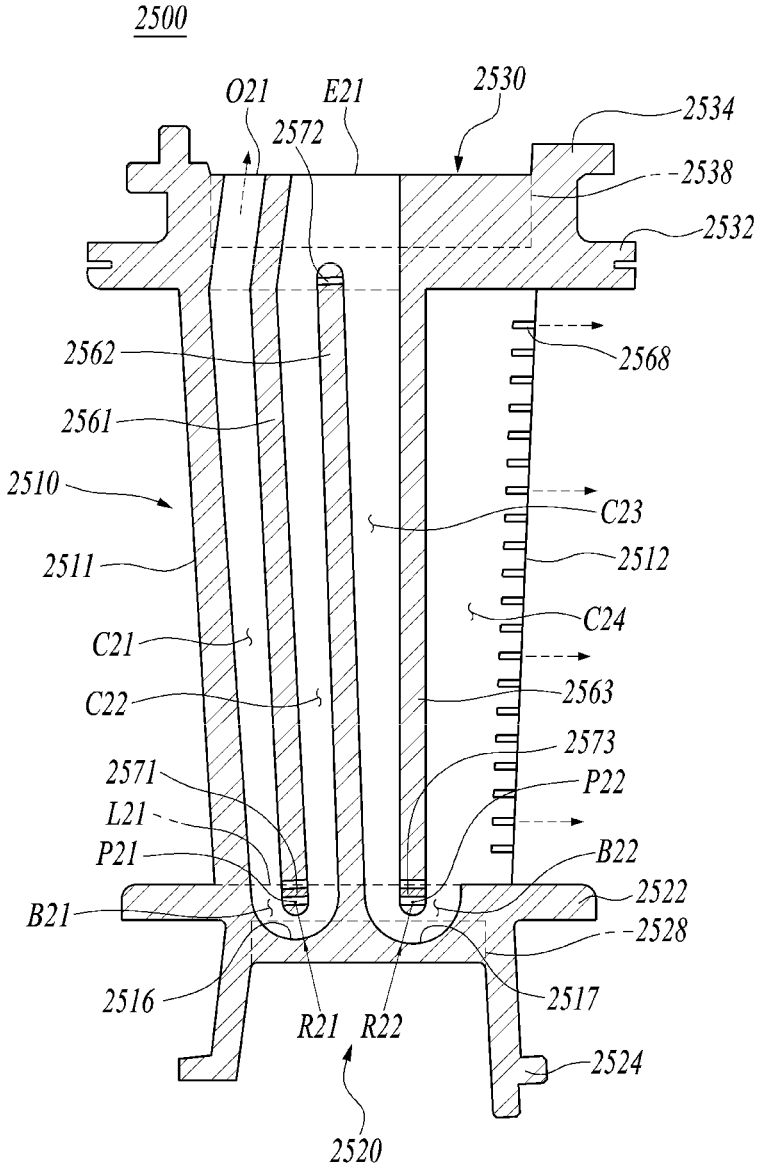
FIG. 6 is a longitudinal cross-sectional diagram illustrating a turbine vane according to another exemplary embodiment.
Figure 7:
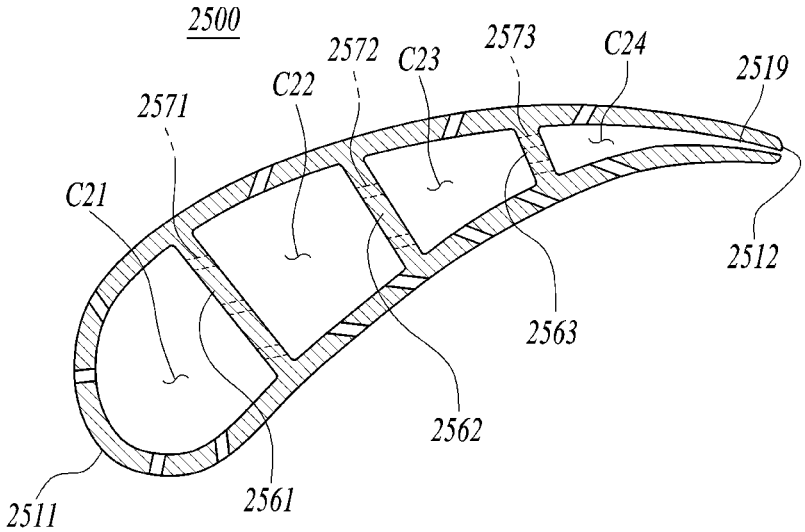
FIG. 7 is a transverse cross-sectional diagram illustrating the turbine vane according to another exemplary embodiment.

FIG. 6 is a longitudinal cross-sectional diagram illustrating a vane according to another exemplary embodiment, and FIG. 7 is a transverse cross-sectional diagram illustrating the vane according to the exemplary embodiment.

Referring to FIGS. 6 and 7, a turbine vane 2500 includes an inner shroud 2520, an outer shroud 2530, and an airfoil 2510 which is positioned between the inner shroud 2520 and the outer shroud 2530.

The airfoil 2510 may be a curved plate having a wing shape, and have an optimized airfoil according to the specification of a gas turbine. The airfoil 2510 may include a leading edge 2511 disposed at an upstream side and a trailing edge 2512 disposed at a downstream side with respect to a flow direction of the combustion gas.

The inner shroud 2520 is coupled to the rotor disk and disposed at the inner end of the airfoil 2510 to support the airfoil 2510. The inner shroud 2520 includes an inner platform 2522 coupled to the interior of the airfoil 2510 and an inner hook 2524 which protrudes downward from the inner platform 2522 and is coupled to the rotor disk.

The inner platform 2522 is formed in a substantially rectangular plate shape and is formed with an inner protrusion 2528 which protrudes to form a space therein. The inner protrusion 2528 protrudes inward, which is a direction toward the rotor disk, and has the transverse cross section shaped like the airfoil. That is, the transverse cross section of the inner protrusion 2528 includes a convex surface and a concave surface, and is formed so that a gap between the convex surface and the concave surface reduces toward the side end thereof.

The outer shroud 2530 is coupled to a vane carrier (not illustrated) installed outside in a radial direction thereof and disposed at the outer end of the airfoil 2510 to support the airfoil 2510. The outer shroud 2530 includes an outer platform 2532 coupled to the outer end of the airfoil 2510 and an outer hook 2534 which protrudes upward from the outer platform 2532 and is coupled to the vane carrier.

The outer platform 2532 is formed in a substantially rectangular plate shape, and is formed with an outer protrusion 2538 which protrudes to form a space therein. The outer protrusion 2538 protrudes outward, and has the transverse cross section shaped like the airfoil. That is, the transverse cross section of the outer protrusion 2538 includes a convex surface and a concave surface, and is formed so that a gap between the convex surface and the concave surface reduces toward the side end thereof. The outer protrusion 2538 may be formed with an inlet (E21) through which the cooling medium is introduced and an outlet (O21) through which the cooling medium is discharged. For example, the cooling medium may include the air compressed by the compressor. It is understood that the cooling medium is not limited thereto.

A first cooling passage (C21), a second cooling passage (C22), a third cooling passage (C23), a fourth cooling passage (C24), a first passage bending part (B21), a second passage bending part (B22), a first partition wall 2561, a second partition wall 2562, and a third partition wall 2563 are formed inside the turbine vane 2500. The turbine vane 2500 may be formed by casting.

The first cooling passage (C21) is connected to the outlet (O21), and is formed to extend from the outer shroud 2530 to the interior of the inner shroud 2520 through the airfoil 2510. The first cooling passage (C21) is formed by the first partition wall 2561 and the leading edge 2511, and is formed to penetrate the outer protrusion 2538, the outer platform 2532, and the airfoil 2510 in a height direction thereof.

The second cooling passage (C22) is connected to the inlet (E21) and formed to extend from the outer shroud 2530 to the interior of the inner shroud 2520 through the airfoil 2510. The second cooling passage (C22) is formed by the first partition wall 2561 and the second partition wall 2562. The air introduced through the second cooling passage (C22) may be supplied to the first cooling passage (C21).

The first partition wall 2561 is positioned between the first cooling passage (C21) and the second cooling passage (C22), and splits the first cooling passage (C21) and the second cooling passage (C22). The longitudinal outer end of the first partition wall 2561 is fixed to the outer shroud 2530, and the longitudinal inner end of the first partition wall 2561 is positioned to be spaced apart from the end of the airfoil 2510. That is, the first partition wall 2561 is formed to penetrate the airfoil 2510 and extend to the interior of the inner shroud 2520.

The first cooling passage (C21) and the second cooling passage (C22) are connected by the first passage bending part (B21) which is spaced apart from the end of the airfoil 2510 and positioned inside the inner shroud 2520. For example, the first passage bending part (B21) may be positioned within the inner protrusion 2528. In addition, the first passage bending part (B21) has a first curved surface 2516 which is curved in an arc shape and has an arc-shaped cross section having a first radius (R21) around a first point (P21). Here, the first point (P21) is spaced apart from the end of the airfoil 2510 and positioned inside the inner shroud 2520.

Although the turbine vane 2500 is entirely cooled by the cooling passage, it is confirmed that thermal stress is concentrated in the first passage bending part (B21) which is a portion in which the cooling passage is switched, thereby reducing the life of the structure.

The hot gas passes through only a portion in which the airfoil 2510 is formed, and the inner shroud 2520 and the outer shroud 2530 are fitted into other members, thereby not contacting the hot gas. Accordingly, if the first passage bending part (B21) is positioned inside the inner shroud 2520, the thermal stress applied to the first passage bending part (B21) may be minimized.

The first partition wall 2561 may include a plurality of inducing holes 2571 which penetrate the first partition wall 2561 in a thickness direction to induce the flow of air. The inducing holes 2571 may be arranged to be spaced apart from each other in a height direction of the first partition wall 2561 as well as being arranged to be spaced apart from each other in a width direction of the first partition wall 2561. Some inducing holes 2571 may be positioned further outward than the end of the airfoil 2510 with respect to the center of the turbine vane 2500. Some inducing holes 2571 are formed inside the inner shroud 2520 and the inducing hole 2571 may pass through the portion in which the first point (P21) is positioned. Accordingly, the first partition wall 2561 is cooled by the inducing hole 2571 and a portion having a large thermal stress in the turbine vane 2500 may be cooled through the first partition wall 2561.

In addition, some inducing holes 2571 may be positioned on a boundary line (L21) in which the airfoil 2510 and the inner platform 2522 are connected. That is, a part of one inducing hole 2571 may be positioned within the airfoil 2510 and a part thereof may be positioned within the inner platform 2522. Accordingly, the thermal stress at the boundary portion may be minimized.

The third cooling passage (C23) disposed adjacent to the second cooling passage (C22) is formed to extend from the outer shroud 2530 to the interior of the inner shroud 2520 through the airfoil 2510. The third cooling passage (C23) is formed by the second partition wall 2562 and the third partition wall 2563, and is formed to penetrate the outer protrusion 2538, the outer platform 2532, and the airfoil 2510 in a height direction thereof.

The third cooling passage (C23) is connected to the inlet (E21), and the air introduced through the inlet (E21) moves by being split into the second cooling passage (C22) and the third cooling passage (C23), respectively. The air moving through the third cooling passage (C23) may be supplied to the fourth cooling passage (C24).

The second partition wall 2562 is positioned between the second cooling passage (C22) and the third cooling passage (C23), and splits the second cooling passage (C22) and the third cooling passage (C23). The longitudinal inner end of the second partition wall 2562 is fixed to the inner shroud 2520, and the longitudinal outer end thereof is positioned further outward than the end of the airfoil 2510. That is, the second partition wall 2562 penetrates the airfoil 2510 and extends to the interior of the outer shroud 2530 and is spaced apart from the inlet (E21). Accordingly, it is possible to prevent the thermal stress from being concentrated at the end of the second partition wall 2562.

The second partition wall 2562 may include a plurality of inducing holes 2572 which penetrate the second partition wall 2562 in a thickness direction thereof. The inducing holes 2572 may be arranged to be spaced apart from each other in a width direction of the second partition wall 2562. The inducing hole 2572 may be positioned further outward than the end of the airfoil 2510 with respect to the center of the turbine vane 2500. That is, the inducing hole 2572 may be positioned inside the outer shroud 2530. Accordingly, the second partition wall 2562 is cooled by the inducing hole 2572 and a portion having a large thermal stress in the turbine vane 2500 may be cooled through the second partition wall 2562.

The fourth cooling passage (C24) disposed between the third cooling passage (C23) and the trailing edge 2512 is formed to extend to the airfoil 2510 and the interior of the inner shroud 2520. The fourth cooling passage (C24) is formed by the third partition wall 2563 and the trailing edge 2512. The fourth cooling passage (C24) receives air from the third cooling passage (C23) and the air introduced into the fourth cooling passage (C24) is discharged through the trailing edge 2512. A rear end cooling slot 2519 is formed on the trailing edge 2512, and a split protrusion 2568 is formed on the rear end cooling slot 2519, and the air cools the trailing edge 2512 while being discharged through the rear end cooling slot 2519.

The third partition wall 2563 is positioned between the third cooling passage (C23) and the fourth cooling passage (C24), and splits the third cooling passage (C23) and the fourth cooling passage (C24). The longitudinal outer end of the third partition wall 2563 is fixed to the outer shroud 2530, and the longitudinal inner end of the third partition wall 2563 is spaced apart from the end of the airfoil 2510 and positioned further outward than the center of the turbine vane 2500. That is, the third partition wall 2563 is formed to penetrate the airfoil 2510 and extend to the interior of the inner shroud 2520.

The third cooling passage (C23) and the fourth cooling passage (C24) are connected by the second passage bending part (B22) which is spaced apart from the end of the airfoil 2510 and positioned inside the inner shroud 2520. For example, the second passage bending part (B22) may be positioned within the inner platform 2522 and the inner protrusion 2528. In addition, the second passage bending part (B22) has a second curved surface 2517 which is curved in an arc shape and has an arc-shaped cross section having a second radius (R22) around a second point (P22). Here, the second point (P22) is spaced apart from the end of the airfoil 2510 and positioned inside the inner shroud 2520. Accordingly, thermal stress generated in the second passage bending part (B22) may be minimized and the life of the structure in the second passage bending part (B22) may be improved.

The third partition wall 2563 may include a plurality of inducing holes 2573 which penetrate the third partition wall 2563 in a thickness direction thereof. The inducing holes 2573 may be arranged to be spaced apart from each other in a height direction of the third partition wall 2563 as well as being arranged to be spaced apart from each other in a width direction of the third partition wall 2563. Some inducing holes 2573 may be positioned further outward than the end of the airfoil 2510 with respect to the center of the turbine vane 2500. Some inducing holes 2573 are formed inside the inner shroud 2520 and the inducing hole 2573 may pass through the portion in which the second point (P22) is positioned. Accordingly, the third partition wall 2563 is cooled by the inducing hole 2573 and a portion having a large thermal stress in the turbine vane 2500 may be cooled through the third partition wall 2563.

In addition, some inducing holes 2573 may be positioned on the boundary surface in which the airfoil 2510 and the inner platform 2522 are connected. That is, a part of one inducing hole 2573 may be positioned within the airfoil 2510 and a part thereof may be positioned within the inner platform 2522. Accordingly, the thermal stress at the boundary portion may be minimized.

Figure 8:
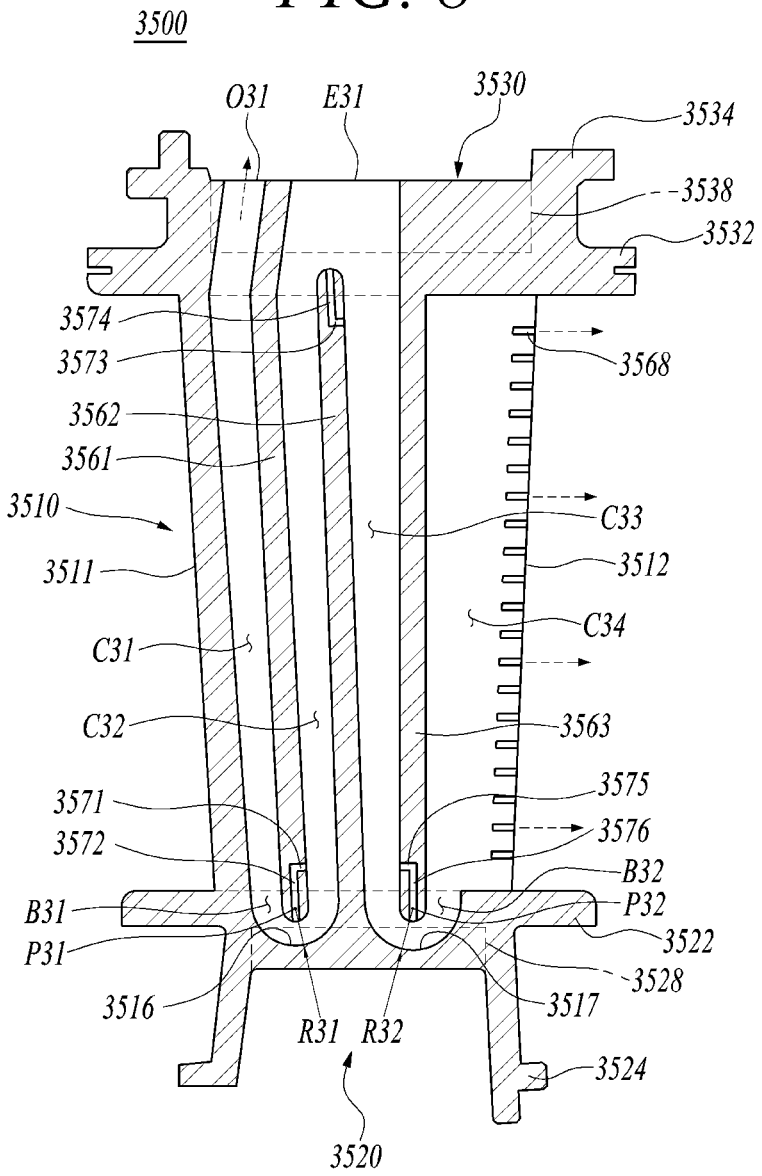
FIG. 8 is a longitudinal cross-sectional diagram illustrating a turbine vane according to another exemplary embodiment.

FIG. 8 is a longitudinal cross-sectional diagram illustrating a vane according to another exemplary embodiment.

Referring to FIG. 8, a turbine vane 3500 includes an inner shroud 3520, an outer shroud 3530, and an airfoil 3510 which is positioned between the inner shroud 3520 and the outer shroud 3530.

The airfoil 3510 may be a curved plate having a wing shape, and have an optimized airfoil according to the specification of a gas turbine. The airfoil 3510 may include a leading edge 3511 disposed at an upstream side and a trailing edge 3512 disposed at a downstream side with respect to a flow direction of the combustion gas.

The inner shroud 3520 is coupled to a rotor disk and disposed at the inner end of the airfoil 3510 to support the airfoil 3510. The inner shroud 3520 includes an inner platform 3522 coupled to the interior of the airfoil 3510 and an inner hook 3524 which protruded downward from the inner platform 3522 and is coupled to the rotor disk.

The inner platform 3522 is formed in a substantially rectangular plate shape and is formed with an inner protrusion 3528 which protrudes to form a space therein. The inner protrusion 3528 protrudes inward, which is a direction toward the rotor disk, and has the transverse cross section shaped like the airfoil. That is, the transverse cross section of the inner protrusion 3528 includes a convex surface and a concave surface, and is formed so that a gap between the convex surface and the concave surface reduces toward the side end thereof.

The outer shroud 3530 is coupled to a vane carrier (not illustrated) installed outside in a radial direction thereof and disposed at the outer end of the airfoil 3510 to support the airfoil 3510. The outer shroud 3530 includes an outer platform 3532 coupled to the outer end of the airfoil 3510 and an outer hook 3534 which protrudes upward from the outer platform 3532 and is coupled to the vane carrier.

The outer platform 3532 is formed in a substantially rectangular plate shape, and is formed with an outer protrusion 3538 which protrudes to form a space therein. The outer protrusion 3538 protrudes outward, and has the transverse cross section shaped like the airfoil. That is, the transverse cross section of the outer protrusion 3538 includes a convex surface and a concave surface, and is formed so that a gap between the convex surface and the concave surface reduces toward the side end thereof. The outer protrusion 3538 is formed with an inlet (E31) through which the cooling medium is introduced and an outlet (O31) through which the cooling medium is discharged. For example, the cooling medium may include the air compressed by the compressor. It is understood that the cooling medium is not limited thereto.

A first cooling passage (C31), a second cooling passage (C32), a third cooling passage (C33), a fourth cooling passage (C34), a first passage bending part (B31), a second passage bending part (B32), a first partition wall 3561, a second partition wall 3562, and a third partition wall 3563 are formed inside the turbine vane 3500. The turbine vane 3500 may be formed by casting.

The first cooling passage (C31) is connected to the outlet (O31), and is formed to extend from the outer shroud 3530 to the interior of the inner shroud 3520 through the airfoil 3510. The first cooling passage (C31) is formed by the first partition wall 3561 and the leading edge 3511, and is formed to penetrate the outer protrusion 3538, the outer platform 3532, and the airfoil 3510 in a height direction thereof.

The second cooling passage (C32) is connected to the inlet (E31), and is formed to extend from the outer shroud 3530 to the interior of the inner shroud 3520 through the airfoil 3510. The second cooling passage (C32) is formed by the first partition wall 3561 and the second partition wall 3562. The air introduced through the second cooling passage (C32) may be supplied to the first cooling passage (C31).

The first partition wall 3561 is positioned between the first cooling passage (C31) and the second cooling passage (C32), and splits the first cooling passage (C31) and the second cooling passage (C32). The longitudinal outer end of the first partition wall 3561 is fixed to the outer shroud 3530, and the longitudinal inner end of the first partition wall 3561 is positioned to be spaced apart from the end of the airfoil 3510. That is, the first partition wall 3561 is formed to penetrate the airfoil 3510 and extend to the interior of the inner shroud 3520.

The first cooling passage (C31) and the second cooling passage (C32) are connected by the first passage bending part (B31) which is spaced apart from the end of the airfoil 3510 and positioned inside the inner shroud 3520. For example, the first passage bending part (B31) may be positioned within the inner protrusion 3528. In addition, the first passage bending part (B31) has a first curved surface 3516 which is curved in an arc shape and has an arc-shaped cross section having a first radius (R31) around a first point (P31). Here, the first point (P31) is spaced from the end of the airfoil 3510 and positioned inside the inner shroud 3520.

It is confirmed that the turbine vane 3500 is entirely cooled by the cooling passage, but thermal stress is concentrated in the first passage bending part (B31) which is a portion in which the cooling passage is switched, thereby reducing the life of the structure.

The hot gas passes through only the portion in which the airfoil 3510 is formed, and the inner shroud 3520 and the outer shroud 3530 are fitted into other members, thereby not contacting the hot gas. Accordingly, if the first passage bending part (B31) is positioned inside the inner shroud 3520, the thermal stress applied to the first passage bending part (B31) may be minimized.

The first partition wall 3561 may include a first passage 3571 extending in a thickness direction of the first partition wall 3561 and a second passage 3572 which is connected to the first passage 3571 and extends to the end of the first partition wall 3561. The first passage 3571 is positioned inside the airfoil 3510, and the second passage 3572 is formed to extend from the interior of the airfoil 3510 to the interior of the inner shroud 3520 in a height direction of the first partition wall 3561. The second passage 3572 may pass through the portion in which the first point (P31) is positioned.

Air may be introduced into the first passage 3571 and discharged to the end of the first partition wall 3561 through the second passage 3572. The air moves and cools the first partition wall 3561 and a portion having a large thermal stress may be cooled through the first partition wall 3561. Because the first point (P31) is positioned within the second passage 3572, the portion having the large thermal stress may be efficiently cooled.

The third cooling passage (C33) disposed adjacent to the second cooling passage (C32) is formed to extend from the outer shroud 3530 to the interior of the inner shroud 3520 through the airfoil 3510. The third cooling passage (C33) is formed by the second partition wall 3562 and the third partition wall 3563, and is formed to penetrate the outer protrusion 3538, the outer platform 3532, and the airfoil 3510 in a height direction thereof.

The third cooling passage (C33) is connected to the inlet (E31), and the air introduced through the inlet (E31) moves by being split into the second cooling passage (C32) and the third cooling passage (C33). The air moving through the third cooling passage (C33) may be supplied to the fourth cooling passage (C34).

The second partition wall 3562 is positioned between the second cooling passage (C32) and the third cooling passage (C33), and splits the second cooling passage (C32) and the third cooling passage (C33). The longitudinal inner end of the second partition wall 3562 is fixed to the inner shroud 3520, and the longitudinal outer end thereof is positioned further outward than the end of the airfoil 3510. That is, the second partition wall 3562 penetrates the airfoil 3510 and extends to the interior of the outer shroud 3530 and is spaced apart from the inlet (E31). Accordingly, it is possible to prevent the thermal stress from being concentrated at the end of the second partition wall 3562.

The second partition wall 3562 may include a first passage 3573 extending in a thickness direction of the second partition wall 3562 and a second passage 3574 which is connected to the first passage 3573 and extends to the end of the second partition wall 3562. The first passage 3573 is positioned inside the airfoil 3510, and the second passage 3574 is formed to extend from the interior of the airfoil 3510 to the interior of the outer shroud 3530 in a height direction of the second partition wall 3562.

Air may be introduced into the second passage 3574 and discharged to the end of the second partition wall 3562 through the first passage 3573. The air moves and cools the second partition wall 3562, and a portion having a large thermal stress may be cooled through the second partition wall 3562.

The fourth cooling passage (C34) disposed between the third cooling passage (C33) and the trailing edge 3512 is formed to extend to the airfoil 3510 and the interior of the inner shroud 3520. The fourth cooling passage (C34) is formed by the third partition wall 3563 and the trailing edge 3512. The fourth cooling passage (C34) receives air from the third cooling passage (C33) and the air introduced into the fourth cooling passage (C34) is discharged through the trailing edge 3512. A rear end cooling slot is formed in the trailing edge 3512, a split protrusion 3568 is formed in the rear end cooling slot, and the air is discharged through the rear end cooling slot to cool the trailing edge 3512.

The third partition wall 3563 is positioned between the third cooling passage (C33) and the fourth cooling passage (C34), and splits the third cooling passage (C33) and the fourth cooling passage (C34). The longitudinal outer end of the third partition wall 3563 is fixed to the outer shroud 3530, and the longitudinal inner end of the third partition wall 3563 is spaced apart from the end of the airfoil 3510 and is positioned further outward than the center of the turbine vane 3500. That is, the third partition wall 3563 is formed to penetrate the airfoil 3510 and extend to the interior of the inner shroud 3520.

The third cooling passage (C33) and the fourth cooling passage (C34) are connected by the second passage bending part (B32) which is spaced apart from the end of the airfoil 3510 and positioned inside the inner shroud 3520. For example, the second passage bending part (B32) may be positioned within the inner platform 3522 and the inner protrusion 3528. In addition, the second passage bending part (B32) has a second curved surface 3517 which is curved in an arc shape and has an arc-shaped cross section having a second radius (R32) around a second point (P32). Here, the second point (P32) is spaced from the end of the airfoil 3510 and positioned inside the inner shroud 3520. Accordingly, thermal stress generated in the second passage bending part (B32) may be minimized, and the life of the structure in the second passage bending part (B32) may be improved.

The third partition wall 3563 may include a first passage 3575 extending in a thickness direction of the third partition wall 3563 and a second passage 3576 which is connected to the first passage 3575 and extends to the end of the third partition wall 3563. The first passage 3575 is positioned inside the airfoil 3510, and the second passage 3576 is formed to extend from the interior of the airfoil 3510 to the interior of the inner shroud 3520 in a height direction of the third partition wall 3563. The second passage 3576 may pass through the portion in which the second point (P32) is positioned.

Air may be introduced into the first passage 3575 and discharged to the end of the third partition wall 3563 through the second passage 3576. The air moves and cools the third partition wall 3563 and a portion having a large thermal stress may be cooled through the third partition wall 3563. Because the second point (P32) is positioned within the second passage 3576, the portion having the large thermal stress may be efficiently cooled.

Figure 9:
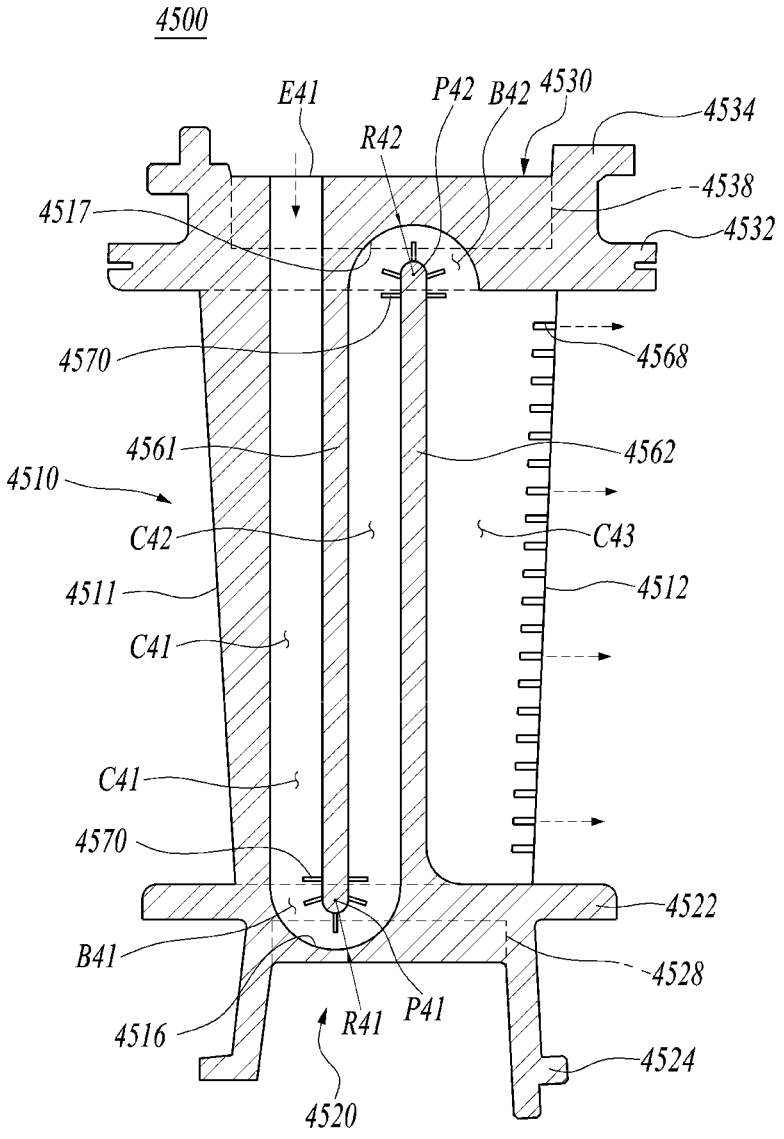
FIG. 9 is a longitudinal cross-sectional diagram illustrating a turbine vane according to another exemplary embodiment.

FIG. 9 is a longitudinal cross-sectional diagram illustrating a vane according to another exemplary embodiment.

Referring to FIG. 9, a turbine vane 4500 includes an inner shroud 4520, an outer shroud 4530, and an airfoil 4510 which is positioned between the inner shroud 4520 and the outer shroud 4530.

The airfoil 4510 may be a curved plate having a wing shape, and have an optimized airfoil according to the specification of a gas turbine. The airfoil 4510 may include a leading edge 4511 disposed at an upstream side and a trailing edge 4512 disposed at a downstream side with respect to a flow direction of the combustion gas.

The inner shroud 4520 is coupled to a rotor disk and disposed at the inner end of the airfoil 4510 to support the airfoil 4510. The inner shroud 4520 includes an inner platform 4522 coupled to the interior of the airfoil 4510 and an inner hook 4524 which protrudes downward from the inner platform 4522 and is coupled to the rotor disk.

The inner platform 4522 is formed in a substantially rectangular plate shape and is formed with an inner protrusion 4528 which protrudes to form a space therein. The inner protrusion 4528 protrudes inward, which is a direction toward the rotor disk, and has the transverse cross section shaped like the airfoil. That is, the transverse cross section of the inner protrusion 4528 includes a convex surface and a concave surface, and is formed so that a gap between the convex surface and the concave surface reduces toward the side end thereof.

The outer shroud 4530 is coupled to a vane carrier (not illustrated) installed outside in a radial direction thereof and disposed at the outer end of the airfoil 4510 to support the airfoil 4510. The outer shroud 4530 includes an outer platform 4532 coupled to the outer end of the airfoil 4510 and an outer hook 4534 which protrudes upward from the outer platform 4532 and is coupled to the vane carrier.

The outer platform 4532 is formed in a substantially rectangular plate shape, and is formed with an outer protrusion 4538 which protrudes to form a space therein. The outer protrusion 4538 protrudes outward, and has the transverse cross section shaped like the airfoil. That is, the transverse cross section of the outer protrusion 4538 includes a convex surface and a concave surface, and is formed so that a gap between the convex surface and the concave surface reduces toward the side end thereof. The outer protrusion 4538 may be formed with an inlet (E41) through which the cooling medium is introduced. For example, the cooling medium may include the air compressed by the compressor. It is understood that the cooling medium is not limited thereto.

A first cooling passage (C41), a second cooling passage (C42), a third cooling passage (C43), a first passage bending part (B41), a second passage bending part (B42), a first partition wall 4561, and a second partition wall 4562 are formed inside the turbine vane 4500. The turbine vane 4500 may be formed by casting.

The first cooling passage (C41) is connected to the inlet (E41), and is formed to extend from the outer shroud 4530 to the interior of the inner shroud 4520 through the airfoil 4510. The first cooling passage (C41) is formed by the first partition wall 4561 and the leading edge 4511, and is formed to penetrate the outer protrusion 4538, the outer platform 4532, and the airfoil 4510 in a height direction thereof. The air introduced into the first cooling passage (C41) may be supplied to the second cooling passage (C42).

The second cooling passage (C42) is formed to extend from the outer shroud 4530 to the interior of the inner shroud 4520 through the airfoil 4510. The second cooling passage (C42) is formed by the first partition wall 4561 and the second partition wall 4562. The second cooling passage (C42) receives air from the first cooling passage (C41), and supplies the air to the third cooling passage (C43).

The first partition wall 4561 is positioned between the first cooling passage (C41) and the second cooling passage (C42), and splits the first cooling passage (C41) and the second cooling passage (C42). The longitudinal outer end of the first partition wall 4561 is fixed to the outer shroud 4530, and the longitudinal inner end of the first partition wall 4561 is positioned to be spaced apart from the end of the airfoil 4510. That is, the first partition wall 4561 is formed to penetrate the airfoil 4510 and extend to the interior of the inner shroud 4520.

The first cooling passage (C41) and the second cooling passage (C42) are connected by the first passage bending part (B41) which is spaced apart from the end of the airfoil 4510 and positioned inside the inner shroud 4520. For example, the first passage bending part (B41) may be positioned within the inner protrusion 4528. In addition, the first passage bending part (B41) has a first curved surface 4516 which is curved in an arc shape, and has an arc-shaped cross section having a first radius (R41) around a first point (P41). Here, the first point (P41) is spaced apart from the end of the airfoil 4510 and positioned inside the inner shroud 4520.

It is confirmed that the turbine vane 4500 is entirely cooled by the cooling passage, but thermal stress is concentrated in the first passage bending part (B41) which is the portion where the cooling passage is switched, thereby reducing the life of the structure.

The hot gas passes through only the portion in which the airfoil 4510 is formed, and the inner shroud 4520 and the outer shroud 4530 are fitted into other members, thereby not contacting the hot gas. Accordingly, if the first passage bending part (B41) is positioned inside the inner shroud 4520, the thermal stress applied to the first passage bending part (B41) may be minimized.

A plurality of porous plates 4570 are formed to protrude from the first partition wall 4561. Some porous plates 4570 may be positioned within the first passage bending part (B41), and some porous plates 4570 may be positioned within the airfoil 4510 adjacent to the first passage bending part (B41). As described above, if the plurality of porous plates 4570 are formed to protrude from the first partition wall 4561, the first partition wall 4561 and the turbine vane 4500 may be cooled through the porous plate 4570, thereby reducing the thermal stress. The porous plate 4570 may be vertically fixed to an outer surface of the first partition wall 4561, or may be disposed to be inclined toward the end of the turbine vane 4500.

The third cooling passage (C43) disposed between the second cooling passage (C42) and the trailing edge 4512 is formed to extend from the outer shroud 4530 to the airfoil 4510. The third cooling passage (C43) is formed by the second partition wall 4562 and the trailing edge 4512. The third cooling passage (C43) receives air from the second cooling passage (C42) and the air introduced into the third cooling passage (C43) is discharged through the trailing edge 4512. A rear end cooling slot is formed in the trailing edge 4512, a split protrusion 4568 is formed in the rear end cooling slot, and the air is discharged through the rear end cooling slot to cool the trailing edge 4512.

The second partition wall 4562 is positioned between the second cooling passage (C42) and the third cooling passage (C43), and splits the second cooling passage (C42) and the third cooling passage (C43). The longitudinal inner end of the second partition wall 4562 is fixed to the inner shroud 4520, and the longitudinal outer end thereof is positioned further outward than the end of the airfoil 4510. That is, the second partition wall 4562 is formed to penetrate the airfoil 4510 and extend to the interior of the outer shroud 4530.

The second cooling passage (C42) and the third cooling passage (C43) are connected by the second passage bending part (B42) which is spaced apart from the end of the airfoil 4510 and positioned inside the outer shroud 4530. For example, the second passage bending part (B42) may be positioned within the outer platform 4532 and the outer protrusion 4538. In addition, the second passage bending part (B42) has a second curved surface 4517 which is curved in an arc shape and has an arc-shaped cross section having a second radius (R42) around a second point (P42). Here, the second point (P42) is spaced apart from the end of the airfoil 4510 and positioned inside the outer shroud 4530. Accordingly, the thermal stress generated in the second passage bending part (B42) may be minimized and the life of the structure in the second passage bending part (B42) may be improved.

A plurality of porous plates 4570 are formed to protrude from the second partition wall 4562. Some porous plates 4570 may be positioned within the second passage bending part (B42), and some porous plates 4570 may be positioned within the airfoil 4510 adjacent to the second passage bending part (B42). As described above, if the plurality of porous plates 4570 are formed to protrude from the second partition wall 4562, the second partition wall 4562 and the turbine vane 4500 may be cooled through the porous plate 4570, thereby reducing the thermal stress.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A turbine vane comprising:

an airfoil including a leading edge and a trailing edge;

an inner shroud disposed at one end of the airfoil to support the airfoil;

an outer shroud disposed at the other end of the airfoil to support the airfoil and configured to face the inner shroud;

a first cooling passage and a second cooling passage configured to extend in a height direction thereof;

a first passage bending part configured to connect the first cooling passage and the second cooling passage; and a first partition wall configured to split the first cooling passage and the second cooling passage and extend in a height direction of the airfoil, a longitudinal end of the first partition wall being positioned further outward than an end of the airfoil, wherein the first passage bending part is positioned in a space formed inside the inner shroud or the outer shroud, and wherein the first partition wall comprises a plurality of porous plates which protrude from the first partition wall.

2. The turbine vane of claim 1, wherein some porous plates are positioned in the first passage bending part, and some porous plates are positioned within the airfoil.

3. The turbine vane of claim 2, wherein the plurality of porous plates are vertically fixed to an outer surface of the first partition wall, or disposed to be inclined toward an end of the turbine vane.

4. The turbine vane of claim 1, wherein the first passage bending part comprises a first curved surface which is curved in an arc shape around a first point which is positioned inside the inner shroud or the outer shroud.

5. The turbine vane of claim 4, wherein the inner shroud comprises an inner platform connected to an inner end of the airfoil and an inner hook protruding from the inner platform, and wherein the inner platform comprises an inner protrusion which protrudes to form a space therein, and the first passage bending part is positioned inside the inner protrusion.

6. The turbine vane of claim 5, wherein the longitudinal end of the first partition wall is positioned in the inner protrusion of the inner platform.

7. The turbine vane of claim 4, further comprising a third cooling passage configured to extend in a height direction thereof and a second passage bending part configured to connect the second cooling passage and the third cooling passage.

8. The turbine vane of claim 7, wherein the second passage bending part comprises a second curved surface which is curved in an arc shape around a second point which is positioned inside the outer shroud.

9. The turbine vane of claim 8, wherein the outer shroud comprises an outer platform connected to an outer end of the airfoil and an outer hook protruding from the outer platform, and wherein the outer platform comprises an outer protrusion which protrudes outward and forms a space therein, and the second passage bending part is positioned inside the outer protrusion.

10. The turbine vane of claim 9, wherein the outer protrusion comprises a transverse cross section shaped like the airfoil.

11. The turbine vane of claim 9, further comprising a second partition wall configured to split the second cooling passage and the third cooling passage and extend in a height direction of the airfoil, wherein a longitudinal end of the second partition wall is positioned further outward than the end of the airfoil, wherein the second partition wall comprises a plurality of porous plates which protrude from the second partition wall.

12. The turbine vane of claim 11, wherein some porous plates are positioned in the second passage bending part, and some porous plates are positioned within the airfoil.

13. A turbine comprising:

a rotor disk configured to be rotatable; and a plurality of turbine blades and turbine vanes which are installed on the rotor disk, wherein the turbine vane comprises an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, a first passage bending part configured to connect the first cooling passage and the second cooling passage and to include a first curved surface curved in an arc shape around a first point which is positioned inside the inner shroud or the outer shroud, and a first partition wall configured to split the first cooling passage and the second cooling passage and extend in a height direction of the airfoil, a longitudinal end of the first partition wall being positioned further outward than an end of the airfoil, wherein the first passage bending part is positioned in a space formed inside the inner shroud or the outer shroud, and wherein the first partition wall comprises a plurality of porous plates which protrude from the first partition wall.

14. The turbine of claim 13, wherein some porous plates are positioned in the first passage bending part, and some porous plates are positioned within the airfoil.

15. The turbine of claim 14, wherein the inner shroud comprises an inner platform connected to an inner end of the airfoil and an inner hook protruding from the inner platform, and wherein the inner platform comprises an inner protrusion which protrudes to form a space therein, and the first passage bending part is positioned inside the inner protrusion.

16. The turbine of claim 15, wherein the longitudinal end of the first partition wall is positioned in the inner protrusion of the inner platform.

17. The turbine of claim 14, further comprising a third cooling passage configured to extend in a height direction thereof and a second passage bending part configured to connect the second cooling passage and the third cooling passage, wherein the second passage bending part comprises a second curved surface which is curved in an arc shape around a second point which is positioned inside the outer shroud.

18. The turbine of claim 17, wherein the outer shroud comprises an outer platform connected to an outer end of the airfoil and an outer hook protruding from the outer platform, and wherein the outer platform comprises an outer protrusion which protrudes outward and forms a space therein, and the second passage bending part is positioned inside the outer protrusion.

19. The turbine of claim 18, further comprising a second partition wall configured to split the second cooling passage and the third cooling passage and extend in a height direction of the airfoil, wherein a longitudinal end of the second partition wall is positioned further outward than the end of the airfoil, wherein the second partition wall comprises a plurality of porous plates which protrude from the second partition wall, the plurality of porous plates being positioned on the second passage bending part.

20. A gas turbine comprising:

a compressor configured to compress air drawn thereinto from an outside;

a combustor configured to mix fuel with air compressed by the compressor and combust a mixture of the fuel and the compressed air; and a turbine comprising a plurality of turbine blades configured to be rotated by combustion gas discharged from the combustor, wherein the turbine comprises a rotor disk configured to be rotatable, and a plurality of turbine blades and turbine vanes which are installed on the rotor disk, wherein the turbine vane comprises an airfoil including a leading edge and a trailing edge, an inner shroud disposed at one end of the airfoil to support the airfoil, an outer shroud disposed at the other end of the airfoil to support the airfoil and configured to face the inner shroud, a first cooling passage and a second cooling passage configured to extend in a height direction thereof, a first passage bending part configured to connect the first cooling passage and the second cooling passage, and a first partition wall configured to split the first cooling passage and the second cooling passage and extend in a height direction of the airfoil, a longitudinal end of the first partition wall being positioned further outward than an end of the airfoil, wherein the first passage bending part is positioned inside the inner shroud or the outer shroud, and wherein the first partition wall comprises a plurality of porous plates which protrude from the first partition wall, the plurality of porous plates being positioned on the first passage bending part.

* * * * *